United States Patent [19]

Thomas

[11] 4,009,532

[45] Mar. 1, 1977

[54] ADJUSTABLE DISPLAY STANDARD

[76] Inventor: Wayne A. Thomas, 200 N. Van Ness, Los Angeles, Calif. 90004

[22] Filed: Oct. 31, 1975

[21] Appl. No.: 627,549

[52] U.S. Cl. ..... 40/11 A; 40/125 H; 40/128

[51] Int. Cl.[2] ..... G09F 3/14

[58] Field of Search ..... 40/11 A, 11 R, 125 G, 40/155, 10 R, 10 C, 125 H, 125 R, 125 A, 124.1, 125 D, 125 F, 128; 248/161, 205 A; 229/16 D; 206/459

[56] References Cited

UNITED STATES PATENTS

| | | | |
|---|---|---|---|
| 1,116,942 | 11/1914 | Smith | 40/128 |
| 1,832,239 | 11/1931 | Pedersen | 40/128 X |
| 1,870,798 | 8/1932 | Einson | 40/125 G |
| 2,005,859 | 6/1935 | Hoke | 40/124.1 |
| 2,847,774 | 8/1958 | Brooks | 40/10 C |
| 2,939,236 | 6/1960 | Stein | 40/125 G |
| 3,178,138 | 4/1965 | Hessdoerfer et al. | 248/205 A X |
| 3,458,946 | 8/1969 | Lasswell | 248/205 A X |
| 3,889,409 | 6/1975 | Thomas | 40/11 A |
| 3,889,410 | 6/1975 | Thomas | 40/11 A |

FOREIGN PATENTS OR APPLICATIONS

| | | | |
|---|---|---|---|
| 1,077,840 | 5/1954 | France | 40/125 G |

*Primary Examiner*—John F. Pitrelli
*Attorney, Agent, or Firm*—Whann & McManigal

[57] ABSTRACT

A display standard for a sheet-like display member which is folded to provide a top edge fold and confronting side panels having adjacent lower edges. The display member is supported in an elevated position by an upstanding rod-like structure arranged to extend between the lower edges of the panels and at its upper end supportingly engages the underside of the top edge fold. The lower edges of the panels are each provided with a tab for releasingly engaging the rod-like structure so as to stabilize the panels and prevent tilting thereof. The lower end of the rod-like structure is arranged for adhesively mounting upon a surface of a display container, carton, and the like. The rod-like structure comprises two elements which have axially adjustably interconnected overlapped end portions to permit adjustable variation of the supported height of the display member above the container.

8 Claims, 10 Drawing Figures

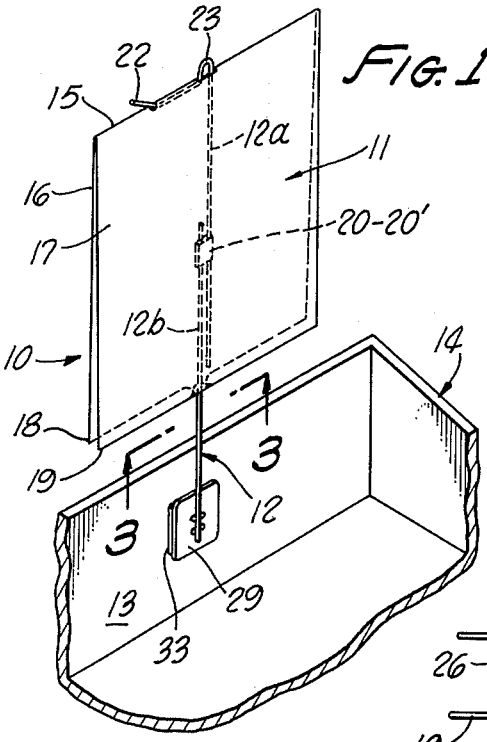
FIG. 1.
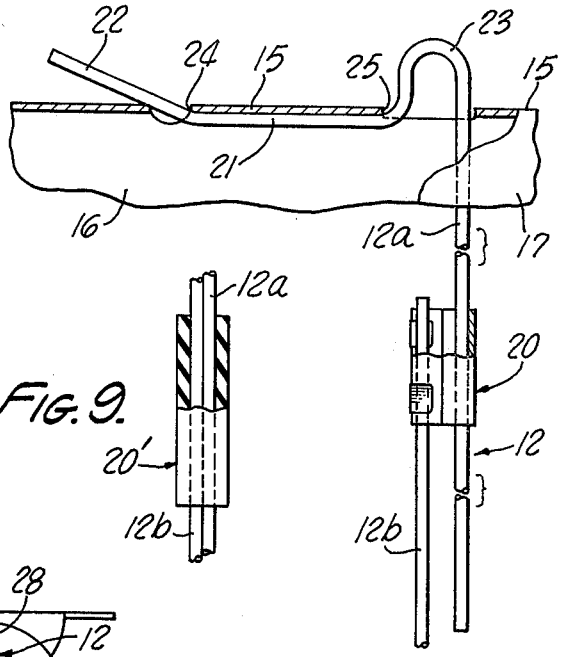
FIG. 2.
FIG. 9.
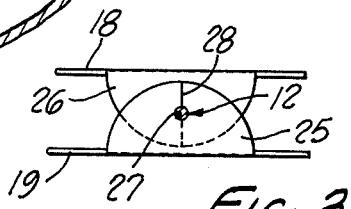
FIG. 3.
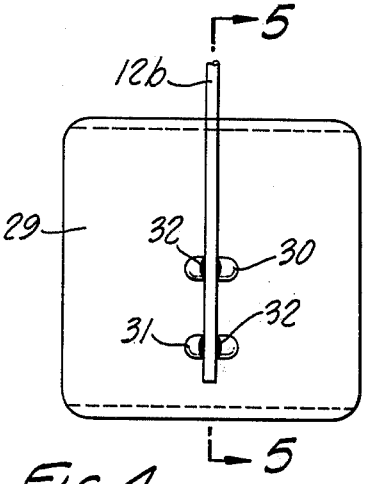
FIG. 4.
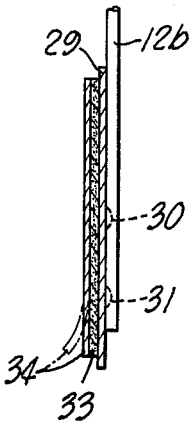
FIG. 5.
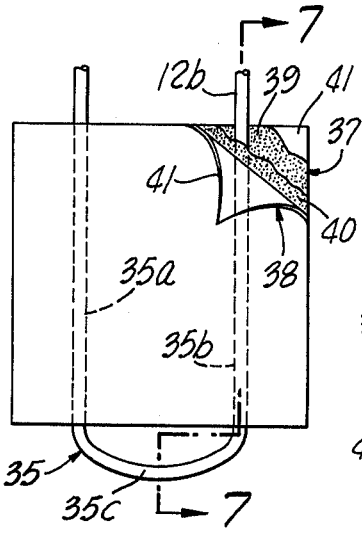
FIG. 6.
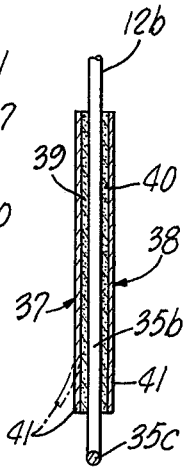
FIG. 7.
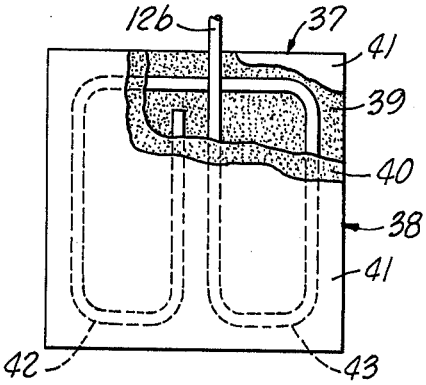
FIG. 8.
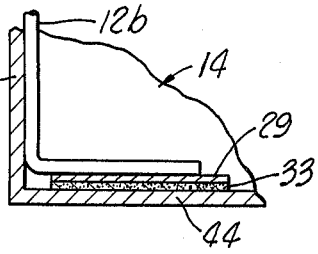
FIG. 10.

ADJUSTABLE DISPLAY STANDARD

PRIOR ART

In the prior art, there are numerous examples of display stands for advertising media and which utilize a wire frame structure for supporting placards and other descriptive materials. The closest art known to applicant are the following patents:

| Patent No. | Date Issued |
|---|---|
| 399,256 | March 12, 1889 |
| 828,542 | August 14, 1906 |
| 1,397,734 | November 22, 1921 |
| 1,435,178 | November 14, 1922 |
| 1,651,652 | December 6, 1927 |
| 2,005,859 | June 25, 1935 |
| 2,180,125 | November 14, 1939 |
| 2,333,302 | November 2, 1943 |
| 2,345,750 | April 4, 1944 |
| 2,504,331 | April 18, 1950 |
| 2,563,159 | August 7, 1951 |
| 2,639,524 | May 26, 1953 |
| 3,889,409 | June 17, 1975 |
| 3,889,410 | June 17, 1975 |

BACKGROUND OF THE INVENTION

The present invention relates generally to the field of advertising display devices.

Heretofore it has been known generally to provide a multiplicity of wire frame structures for holding and supporting display sheets, cards, and the like, containing advertising and other identifying material in connection with item display containers and the like.

One of the most exemplary prior structures is known from U.S. Pat. No. 3,889,409, which discloses an upstanding wire frame in which a first element has parts at one end for extending through openings in a display panel, and a part for supporting the panel between the openings. A hollow tube connector has one end for receiving the other end of the first element, and an opposite end for receiving an end of a second frame element formed at its lower end with an enlarged mounting loop adapted to be secured to a surface by means of an adhesive sheet.

Briefly, the present invention differs from the structure of the above noted patent in that the wire frame embodies first and second elements which are adjustably interconnected to permit variations in the supported height of the displayed member with respect to an associated container or carton containing variously displayed items. The attaching means by which the frame is mounted on the surface of the carton or container is of improved construction, and the display panel is folded along the top edge to provide a pair of facing panels with adjacent lower edges containing unique tabs which are attachable to the adjacent wire frame structure and serve to stabilize the display panels against tilting.

SUMMARY OF THE INVENTION

The present invention relates generally to a supporting structure for advertising, display cards, and the like, and is more particularly concerned with the construction of a preassembled display standard which will be adjustable, and in which the display panels are releasably connectible to the wire supporting frame work so as to be stabilized and held against tilting movements.

It is one object of the herein described invention to provide a preassembled display standard of improved construction which can be releasably mounted upon a surface or the like, and which has an elevated removably supported display panel.

A further object is to provide a display standard according to the foregoing object, which embodies a unique frame structure in which rod-like elements have overlapped end portions which are interconnected for sliding axial adjustments to vary the elevated height position of the display panel.

Another object is to provide a display standard in which the display panel is formed from a sheet-like member folded upon itself along a fold line to provide a top folded edge and opposed facing panels having adjacent lower edges provided with stabilizing attaching tabs for grippingly engaging a supporting rod-like frame structure extending between the lower edges of the facing panels and into engagement with the top folded edge.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only:

FIG. 1 is a fragmentary perspective view of a display standard according to the present invention, and showing its mounted position of use;

FIG. 2 is a sectional, elevational, partially fragmentary view showing the supporting relationship of the rod-like frame structure with the display panel, and one form of adjusting means for the frame structure;

FIG. 3 is an enlarged fragmentary sectional view, taken substantially on line 3—3 of FIG. 1, to show the structure of the stabilizing panel tabs;

FIG. 4 is an enlarged fragmentary elevational view showing one embodiment of the mounting means for attaching the display standard to a surface;

FIG. 5 is a transverse sectional view of the same, taken substantially on line 5—5 of FIG. 4;

FIG. 6 is an enlarged fragmentary elevational view similar to FIG. 4, except showing an alternative construction;

FIG. 7 is a transverse sectional view of the same, taken substantially on line 7—7 of FIG. 6;

FIG. 8 is an enlarged fragmentary elevational view similar to FIG. 4, except showing still another modified construction;

FIG. 9 is an enlarged fragmentary elevational view of an alternative form of adjusting means for the frame structure; and FIG. 10 is an enlarged fragmentary elevational view, partly in section, showing an alternative mounting to that shown in FIG. 1, and wherein the supporting frame structure is secured to a bottom wall of a display carton or container.

DESCRIPTION OF THE SEVERAL EMBODIMENTS

Referring now specifically to the drawings, for illustrative purposes, the display standard of the present invention, as generally indicated by the numeral 10, is shown as comprising a generally rectangular sheet-like display panel that is maintained in elevated vertical upright position by means of a supporting framework 12 having its lower end mounted on a vertical wall surface 13 of a carton, container, or the like, as indicated by the numeral 14.

While the display panel may embody various forms of construction, a preferred arrangement embodies the utilization of a sheet-like material which is folded upon itself along a fold line to provide a folded top edge 15 and opposed facing panels 16 and 17 respectively having adjacently positioned lower edges 18 and 19.

As best seen in FIG. 2, the framework 12 is constructed to provide a first rod-like element 12*a* and a second rod-like element 12*b* which have straight overlapping end portions in parallel relation, and which are interconnected for relative axial adjustments by means of a tubular member 20 such that the elevated height of the display panel may be varied with respect to the associated container 14.

In the structure shown in FIG. 2, the tubular member 20 is of a size to surround both of the elements 12*a* and 12*b*, and is crimped, welded, or otherwise permanently secured to the end portion of one of the elements, while the associated other element is frictionally gripped to permit axial adjustment movements of the associated element therein.

An alternative construction for the tubular member 20 is shown in FIG. 9 and indicated by the numeral 20′. In this instance, the member comprises a tubular sleeve of rubber, plastic, or other resilient material having a tubular passage which will be of appropriate size to resiliently grippingly engage the associated elements 12*a* and 12*b* therein.

With further reference to FIG. 2, it will be noted that the upper end of the element 12*a* is bent to provide an angularly extending arm portion 21. This arm at its outermost end is deflected to form an angularly extending end terminus portion 22, and at its opposite inner end is joined to the upper end of the straight portion of the element 12*a* by an upstanding loop 23. The uppermost end of the element 12*a* is supportingly associated with the display panel 11 by inserting the end terminal portion 22 through an opening 24 formed in the folded top edge 15, and thereafter inserting the loop 23 through a laterally spaced opening 25 in the folded top edge. As thus positioned, the arm 21 underlies the folded edge in supporting engagement therewith, and the end terminus 22 and loop 23 retain the display panel against sidewise shifting with respect to the framework 12.

Referring to FIG. 3, the display panel is further stabilized by the provision of bendable tabs 25 and 26, respectively, on the lower edges 18 and 19 of the facing panels. These tabs are similarly provided at their outermost end with an opening 27 to receive the adjacent frame element therethrough, and are radially slit, as indicated at 28, to enable lateral insertion of the frame element into the opening 27, and in which position it will be frictionally gripped. Thus, these tabs serve to hold the display panel in a proper position and oppose tilting movements thereof.

The lowermost end of the second element 12*b* may be variously constructed for mounting attachment against a flat surface. One such construction, as shown in FIG. 4, embodies the provision of a generally rectangular plate 29 of aluminum or other suitable material. Although it is not necessary, the plate may be deformed to provide upper and lower spaced projections 30 and 31 having depressed central portions 32 for receiving the rod-like end portion of the element 12*b* therein. The end portion may then be welded or otherwise permanently secured to the face of the plate 29. On the opposite side, the plate 29 is covered by a layer of adhesive 33, which is initially covered on its outer surface by a strip sheet 34 adapted to be pulled off at the time it is desired to mount the framework on a wall surface.

The alternative arrangement, as shown in FIG. 6, differs from that just described and illustrated in FIG. 4, by the utilization of a generally U-shaped loop 35 end portion in which parallel legs 35*a* and 35*b* are connected by a bridging portion 35*c*. In this arrangement, the loop 35 is sandwiched between rectangular sheet members 37 and 38 having engaged adhesive coated inner surfaces 39 and 40, the outer surfaces being covered with a strip sheet 41 in each case.

The modified structure shown in FIG. 8 is similar to that of FIG. 6, except for the configuration of the loop. In this embodiment, the loop is formed to provide a pair of generally rectangular lobe portions 42 and 43 which extend on opposite sides of a medial portion of the element 12*b*.

As shown in FIG. 10, the framework may be readily adapted for mounting on a horizontal surface rather than a vertical surface 13 as shown in FIG. 1, for example, the surface of a bottom wall 44 of the carton 14. This is accomplished by merely bending the element 12*b* adjacent the plate 29 or the looped end portion so that it will extend in right angled relation rather than parallel relation to the element.

From the foregoing description and drawings, it will be clearly evident that the delineated objects and features of the invention will be accomplished.

Various modifications may suggest themselves to those skilled in the art without departing from the spirit of my invention, and, hence, I do not wish to be restricted to the specific forms shown or uses mentioned, except to the extent indicated in the appended claims.

I claim:

1. A display standard, comprising:

a. an elevated sheet-like display member folded upon itself along a fold line to provide a top folded edge and at least one facing panel having a lower edge;

b. a tab member centrally carried by said lower edge of said panel, said tab being releasably attachable to the rod-like structure to stabilize the sheet-like member as supported by said rod-like structure against tilting movements, said tab having an opening adjacent a projecting end thereof of a size to receive said rod-like structure, and an end slit extending radially outwardly from said opening to enable relative lateral movement of the rod-like structure into a gripped position in said opening;

c. a first elongated rod-like element having one end formed to releasably engage a top portion of said display member;

d. a second elongated rod-like element having means at one end for attachment to an associated object; and e. a tubular member for adjustably interconnecting and frictionally retaining the respective other ends of said elements in overlapped parallel relation to form an upright support for and extending below the display member, and a support having an axial length adjustment to vary the spacing distance between said attachment means and the elevated position of the display member.

2. A display standard as set forth in claim 1, in which the tubular member is of a resilient material and has a single bore slidably receiving both of said overlapped ends.

3. A display standard as set forth in claim 1, in which the tubular member is of a rigid material and is fixedly secured to one of said other overlapped ends and has a single bore for slidably receiving the other of said other overlapped ends.

4. A display standard as set forth in claim 1, in which said one end of said second element is fixedly secured against one face of a rigid plate member, and an opposite face of said plate member has an adhesive thereon for attaching the plate member to a surface area of the associated object.

5. A display standard as set forth in claim 1, in which said one end of said second element is bent to form a substantially planar U-shaped loop, and in which said loop is at least partially sandwiched between opposed layers of an adhesive material, one of said layers having an outer surface normally covered by a strip sheet which, upon removal, exposes the underlying adhesive surface for adherence to a surface of the associated object.

6. A display standard as set forth in claim 5, wherein said loop is of a configuration to provide a pair of lobe portions sandwiched between the layers of the adhesive material and extending on opposite sides of the element.

7. A display standard according to claim 1, in which the folded sheet-like member provides opposed facing panels having adjacent lower edges; and in which said tab member is formed on each of the adjacent lower edges.

8. A display standard as set forth in claim 1, in which said folded edge has a pair of spaced apart openings, and said arm portion at its innermost end is connected with an upstanding loop adapted to extend through one of said openings, and at its outermost end is connected with an angularly directed end terminus portion adapted to extend through the other of said openings.

* * * * *